US005163677A

United States Patent [19]

Foley

[11] Patent Number: 5,163,677

[45] Date of Patent: Nov. 17, 1992

[54] GOLF DRIVING RANGE

[76] Inventor: Derek F. Foley, 24 Burrows Ave., Bernardsville, N.J. 07924

[21] Appl. No.: 620,900

[22] Filed: Dec. 3, 1990

[51] Int. Cl.[5] ..... A63B 69/36

[52] U.S. Cl. ..... 273/35 B; 273/185 R; 273/181 R; 273/181 H; 273/178 B

[58] Field of Search ..... 273/176 A, 176, 35 R, 273/35 A, 35 B, 178 B, 184, 185, 181 R, 181 H

[56] References Cited

U.S. PATENT DOCUMENTS

| | | | |
|---|---|---|---|
| 1,851,423 | 3/1932 | Ely | 273/176 A |
| 2,003,074 | 5/1935 | Gage | 273/176 A |
| 3,464,703 | 9/1969 | Vallas | 273/176 A |
| 3,649,025 | 3/1972 | Garland | 273/176 A |
| 3,685,832 | 8/1972 | Johnson | 273/176 A |
| 3,897,947 | 8/1975 | Heffley | 273/185 R |
| 3,904,209 | 9/1975 | Thomas | 273/176 A |
| 4,063,738 | 12/1977 | Michalson | 273/176 A |
| 4,763,183 | 6/1987 | Trahan | 273/176 A |

*Primary Examiner*—George J. Marlo
*Attorney, Agent, or Firm*—William T. Hough

[57] ABSTRACT

A golf driving-range for driving golf balls from any of a series of tee-points grouped-together to a single common golf driving fairway having a plurality of spaced-apart greens each with a flagged hole, with preferably one of the greens being surrounded by a man-made pond of water, with also the plurality of greens being separated from the driving tee-points by a stream of water, and with sand traps and with assorted trees, shrubs and/or simulations thereof positioned preferably heterogeneously on the fairway, with at-least two sand traps positioned adjacent each of the spaced-apart greens, and a collection device including a centrifugal pump and a channeling device for separating and collecting golf ball that have fallen into the pond water, and detection and indicator mechanisms indicating onto which green a golf ball falls.

8 Claims, 3 Drawing Sheets

GOLF DRIVING RANGE

PRIOR ART

While there does not exist any known relevant prior art, patents of interest located by a preliminary patentability search in Class 273 at sub-class 176 thereof, include the following. Michalson U.S. Pat. No. 4,063,738 granted Dec. 20, 1977 is directed to a single green with hole and flag thereof, having multiple driving positions spaced radially thereof. Garland U.S. Pat. No. 3,649,025 granted Mar. 14, 1972 relates to a waterborn golf-ball driving target having a mesh net suspended therebeneath for collecting and channeling golf balls into a conduit downwardly to a great depth beneath the shore line for collection. Neither have any disclosure nor teaching pertaining to the present invention described and claimed hereinbelow.

BACKGROUND TO THE INVENTION

There are increasing numbers of people becoming interested in the game of golf, many of whom either are not physically able, or do not have sufficient time, or are devoid of necessary equipment or money to purchase the same, sufficiently to enable them to become avid golfers tracking around the numerous greens of existing golf courses. Additionally, there are numerous golfers who desire to practice under realistic conditions for driving golf balls, who have no adequate opportunity nor facility to do so when traveling to the conventional golf course is not always practical nor feasible. Additionaly, there are others who merely would welcome a new outlet for recreating occasionally. The present invention directed to fulfilling each and all of these needs, as directed to a novel golf driving range.

OBJECTS

Accordingly, objects of the invention including overcoming and/or avoiding difficulties and problems and inconveniences of the type above-noted.

More particularly, another object is to obtain the recreational benefits above-noted and as shall be more fully understood by the following description of the invention.

Another specific object is to enable persons physically unable to endure the physical stress and strain of conventional golf course fairway walking over repeated long distances, to enjoy the sport of golf-like exercise and games.

Another object is to enable a driving range to be more than mere repetitive striking the golf ball with a golf club for distance alone, by adding to the past arrangements more golf-like settings and obstacles to be overcome, to thereby require practice and improving of skill and to require the application of skill and effort to obtain higher scores, much the same as real golf.

Another object is to obtain one or more of preceding objects, together with a novel combination enabling ready collection of hit balls.

Another object is to provide improved tracking and scoring of accurately hit golf balls at the novel golf driving range of this invention.

Another object is to provide a novel golf driving range that enables a golfer to work on and correct flaws in his swing or other related problems.

Other objects become apparent from the preceding and following disclosure.

SUMMARY OF THE INVENTION

The invention may be broadly described as follows. As a part of a golf driving range, there is tee area and structure arranged to provide a golf tee area adapted for driving a golf ball by a manually swung golf club, and a golf driving fairway. The gold driving fairway includes a first plurality of separate golf greens positioned within golf club driving distances from the golf driving tee area and structure above-noted, and a second plurality of hazard or obstacle structures spaced-apart from one-another. A second plurality of hazard structures spaced apart from one-another are located on the golf driving fairway.

In a first preferred embodiment, the second plurality includes a water structure or mechanism or arrangement, being or simulating a lake or pond of water at-least substantially surrounding at-least one of the first plurality of golf greens.

In a second preferred embodiment, the water mechanism includes or visually simulates a brook or stream of water positioned between the golf driving tee means and at-least a major proportion of the first plurality.

In a third preferred embodiment, the second plurality includes at-least one sand trap substantially adjacent each of the first pluraltiy.

In a fourth preferred embodiment, the second plurality includes a separate set of at-least two sand traps substantially adjacent each of the first plurality.

In a fifth preferred embodiment, the second plurality includes a third plurality of at-least one of trees, shrubs, and visual simulations thereof, positioned on the golf driving fairway of which at-least one of the trees, shrubs and simulations thereof is positioned in close proximity to one at-least one of the first plurality.

In a sixth preferred embodiment, the third plurality of at-least one of the trees, shrubs and simulations thereof, are on the golf driving fairway substantially heterogeneously dispersed thereon.

In a seventh preferred embodiment, there is included at-least one practice putting green located substantially forward of the golf driving tee area in a close proximity to the golf driving tee means.

In an eighth preferred embodiment, the practice putting green of the seventh preferred embodiment includes in contact therewith at-least one sand trap.

In a ninth preferred embodiment, there is additionally included a miniature golf structure and area and mechanism thereof providing an area inclusive of a series of a plurality of miniature putting tees and miniature putting lanes and golf holes adapted for playing miniature golf.

In a tenth preferred embodiment, the above-noted water mechanism is a body of water substantially surrounding at-least one of the first plurality, and positioned within the body of water is a golf ball collection device that directs golf balls falling into the body of water into a collection trap-structure adapted for recovering golf balls.

In an eleventh preferred embodiment, the second plurality includes at-least one sand trap substantially adjacent each of the first plurality.

In a twelvth preferred embodiment, there is included at-least one practice putting green located substantially forward of the golf driving tee area in a close proximity to the golf driving tee area and structure above-noted.

In a thirteenth preferred embodiment, the twelvth preferred embodiment of a practice putting green, there is included in contact therewith at-least one sand trap.

In a fourteenth preferred embodiment, there is included a miniature golf area and device and mechanisms thereof providing an area inclusive of a series of a plurality of miniature putting tees and miniature putting lanes and golf holes adapted for playing miniature golf.

In a fifteenth preferred embodiment, the water collection mechanism broadly above-described is a body of water substantially surrounding at-least one of the first plurality, and in which positioned within the body of water is a golf ball collection device or mechanism for directing golf balls falling into the body of water into a collection trap-structure adapted for recovering golf balls. The golf ball collection device includes a channeling structure and mechanism thereof for directing golf balls downward a downwardly inclined plane the golf ball collection means further including a collection vessel and a centrifugal action separator adapted to separate golf balls from water and to direct separated balls to the collection vessel. The golf ball collection devices provides for recycling separated water into the body of water.

In a sixteenth preferred embodiment, there is included detector and signaling device(s) and mechanism(s) thereof providing for registering a golf ball striking or falling on any of the first plurality and for indicating onto which of the first plurality a golf ball has fallen.

In a seventeenth preferred embodiment, the above-described detector and signaling means device and mechanism thereof includes a plurality of distance-indicator visually discernible markers as measured from the above-described golf driving tee areas with different ones of the markers being spaced progressively at greater distances from the golf driving tee areas.

In an eighteenth preferred embodiment, at-least one of the golf driving tee areas is to a major degree closer to the first plurality than at-least another remaining one of the golf driving tee areas.

In a nineteenth preferred embodiment, at-least one of the plurality of greens in the golf driving fairway has a predetermined major higher elevation than at-least a remaining one of said first plurality, typically within the range of about six to about 20 feet.

In a twentieth preferred embodiment, the golf driving fairway ranges in width from about 250 yards to about 400 yards, and ranges in length from about 350 yards to about 400 yards.

In a twenty-first preferred embodiment, the golf driving fairway more preferably ranges in width from about 300 yards to about 350 yards, and ranges in length from about 360 yards to about 490 yards.

In a twenty-second preferred embodiment, the water mechanism and/or structure such as a stream, lake or pond ranges in area from about 200 to about 250 square yards.

The invention may be better understood by making reference to the drawings of the following figures.

THE FIGURES

FIG. 1 diagrammatically illustrates a more preferred embodiment of the invention as above-described in an elevation plan view thereof on a land terrain.

FIG. 2 diagrammatically illustrates the above-described golf-ball collection device and the centrifugal separator and collection vessel and the like, in a symbolic side view thereof.

FIG. 3 diagrammatically illustrates the above-described detector and signaling device and mechanism thereof in flow diagram form.

DETAILED DESCRIPTION

In describing the elements of the invention as illustrated, one indicia is assigned and described for a particular element or feature, description is not repeated for common or related indicia in subsequently described figures and/or embodiments except in certain instance to facilitate clarity and/or understanding.

Figure 1:
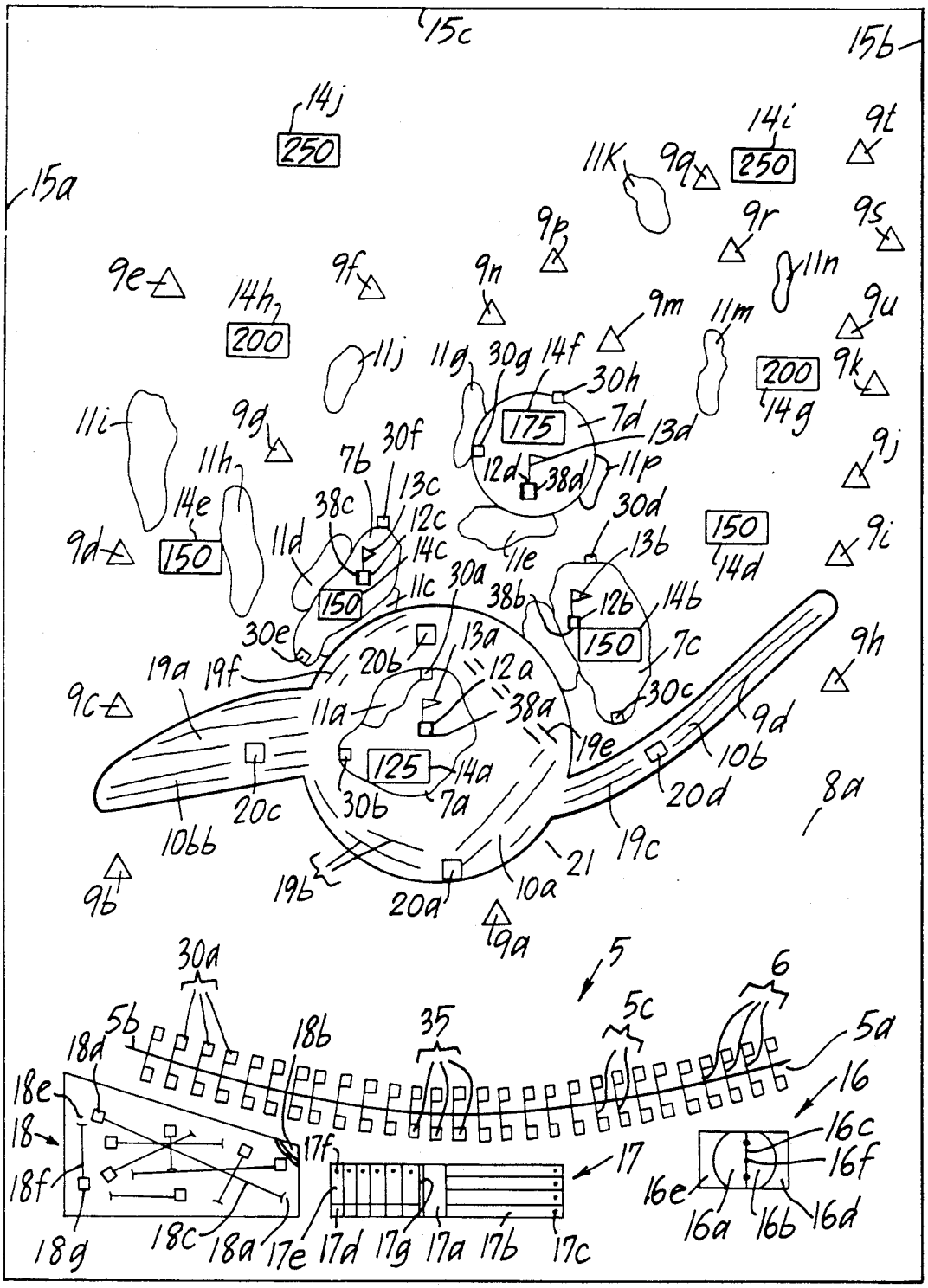

FIG. 1 illustrates the most comprehensive view of the broad inventive driving range symbolically, disclosing the tee areas 5 in side-by-side series of separate tee areas ranging from one end 5*a* thereof to the opposite end thereof 5*b*. The tee areas are boothes separated from one-another by typically upright partitions 5*c* providing privacy and simultaneously preventing undesired distractions by other players in adjacent booths. The tee areas closest to the end 5*a* thereof are more distant from the lake, ponds or the like and to the fairway greens hereinbelow further described, such that women and/or children or less muscular men may choose booths or tee areas more consistent with their individual strengths and/or skills.

Spaced distantly forwardly of the series of tee areas the driving fairway inclusive of the nearest portion 8*a* thereof and the distant portion thereof here separated by the natural and/or artificial stream, ponds or lakes, or visually discernible symbolic representations thereof, designated 10*a* for the central large body of water and 10*b* and 10*bb* for the adjoining smaller and/or narrower bodies of water as illustrated.

The distant fairway portion, inclusive of the lake and/or pond and/or stream portions above-noted, includes the plurality of separate golf greens 7*a* through 7*d* positioned within golf club driving distances from the golf driving tee areas 5 and structure thereof above-noted, and also includes the above-noted plurality of hazard or obstacle structures spaced-apart from one-another—such as the symbolically illustrated trees and/or bushes designated 9*a* through 9*k*, 9*m*, 9*n*, 9*p* and 9*r* through 9*t*, and sand traps 11*a* through 11*m*.

The water body 10*a* above-described surrounds golf green 7*a*.

There is one sand trap 11*a* adjacent golf green 7*a*, and a sand trap adjacent golf green 7*c*, and two sand traps are two spaced-apart sand traps 11*c* and 11*d* adjacent golf green 7*b*, and spaced-apart sand traps 11*g*, 11*e* and 11*p* adjacent golf green 7*d*.

The trees and/or bushes are positioned in close proximity to one or more of the various golf greens above-described, and are shown to be substantially heterogeneously dispersed on the fairway portions 8*a* and 8*b*.

Throughout the fairway portion, there are included detector and/or signaling device(s) and mechanism(s) thereof such as the signs or markers 14*a* through 14*j* indicative of specific distances of a golf ball striking and/or falling on and/or near thereto, relative to the tee area(s) 5. The signs are visually discernible from any one or more of the tee area(s) 5.

Additionally, on at-least one or more of the golf greens 7*a* through 7*d*, there is one or more golf-ball percussion devices, such as typically conventional infra-red ray detectors 30*a* through 30*g* or the like from which golf balls falling on the respective green 7*a* through 7*d* will be detected as it strike or rolls across the green and the signal will be sent through a conventional computer and digitalizer and computer-embodied synchronizer mechanism and fed to the thereby selected booth(s) on a timing basis from which a ball has most recently been struck by a golf club, as is described in greater detail hereinbelow.

The signs and/or infra red or like detectors measure and indicate the particular one of varying distances which is being indicated as measured from the above-described golf driving tee areas with different ones of the markers and/or green and/or infra red detector(s) thereof being spaced progressively at greater distances from the golf driving tee areas; when the particular detector sends its signal, the signal reports on a below-described monitor in terms of a value or score assigned to that particular green and/or marker—as digitalized by the conventional computer above-noted, with larger values and/or score assigned to the more distant targets and/or greens and/or marker and/or those more difficult to achieve in terms of location and numbers and types of above-noted barriers (hazards) such as water, sand traps, trees, bushes or the like.

Figure 3:
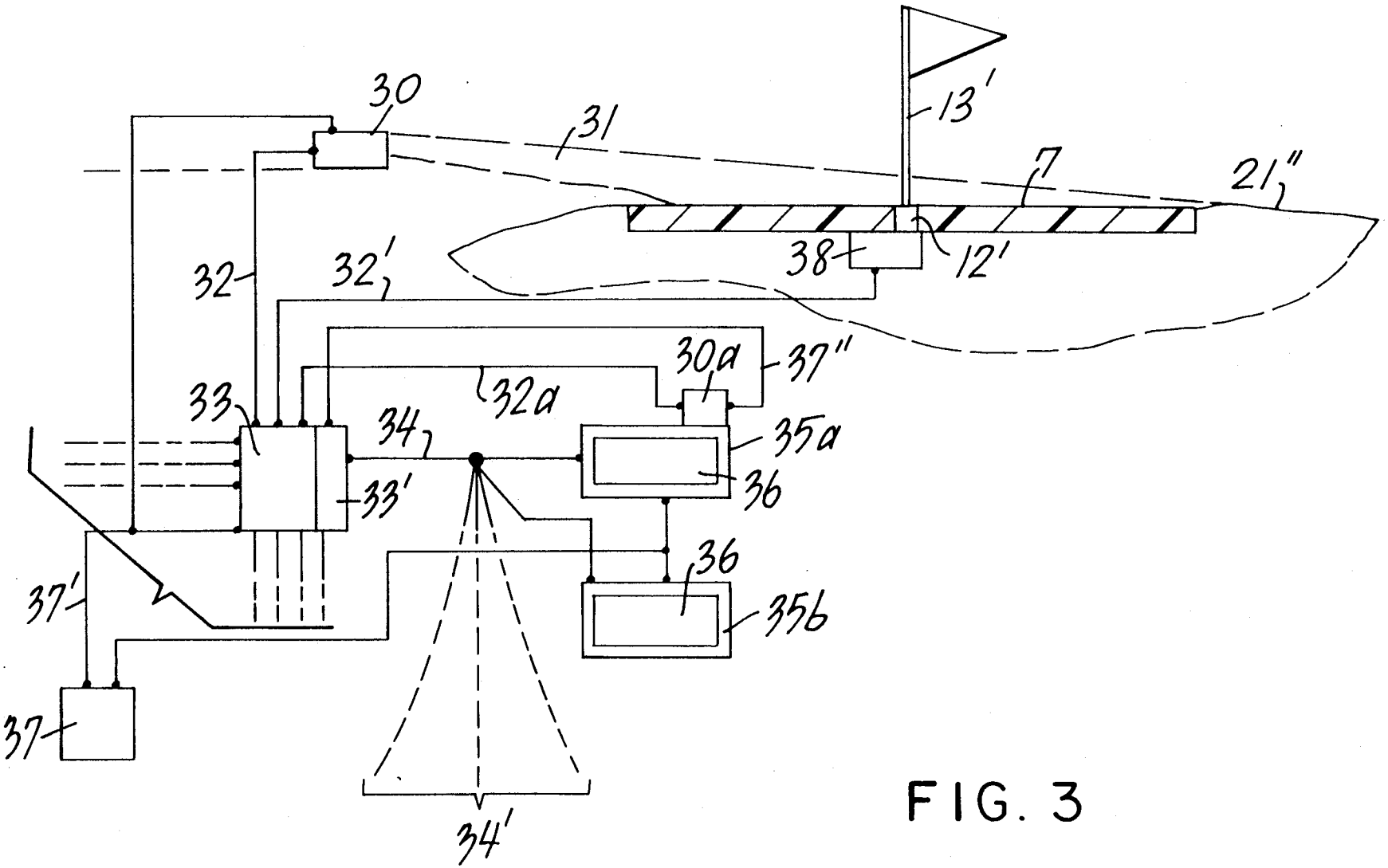

Each green has a hole such as holes 12*a* though 12*d* and has a green-hole golf ball detector(s) 38*a* through 38*d* for registering whenever the ball goes into the hole of that green, and typically when the signal goes (by FIG. 3 circuitry line 32' through the conventional digitizer of the one associated with the conventional computer, the score for that green will be doubled or the like, i.e. a significantly improved score (higher or alternately lower score).

Typically positioned as shown, there are one or more practice putting greens such as practice green 17 located substantially rearward of the golf driving tee area(s) 5. The practice green 17 typically has several alternate long-distance putting positions 17*b* and hole 17*c* thereof. The long-distance positions 17*b* are additionally positioned so as not to interfere with the long-distance putting positions 17*b*, the short-distance plurality of alternate putting positions 17*d*. The long-distance putting positions 17*b* and the short-distance putting positions 17*d* typically have appropriate barrier structure 17*g* separating them to avoid golf balls from transgressing to the adjacent area(s), and have holes 17*f*.

Alternately and/or additionally there is a practice sand blasting cage 16 including one or more sand trap(s) 16*d* and 16*e* associated with one or more adjacent green(s) 16*a* and 16*b* having target(s) (holes) 16*f* and/or and or line(s) 16*c* on the green, toward which golf balls are hit from the sand trap(s).

Alternately and/or additionally there is included typically the miniature golf structure and area 18 and mechanism thereof providing an area inclusive of a series of a plurality of miniature putting tees such as 18*a*, 18*e*, etc., and any desired or random type target(s) 18*b*, 18*d*, 18*g*, etc. (which may or may not be a "hole") and miniature putting lanes 18*c*, 18*f*, etc., adapted for playing miniature golf. The tee position 18*a* is the starting point, and the target 18*b* is the last-target of the series.

Figure 2:
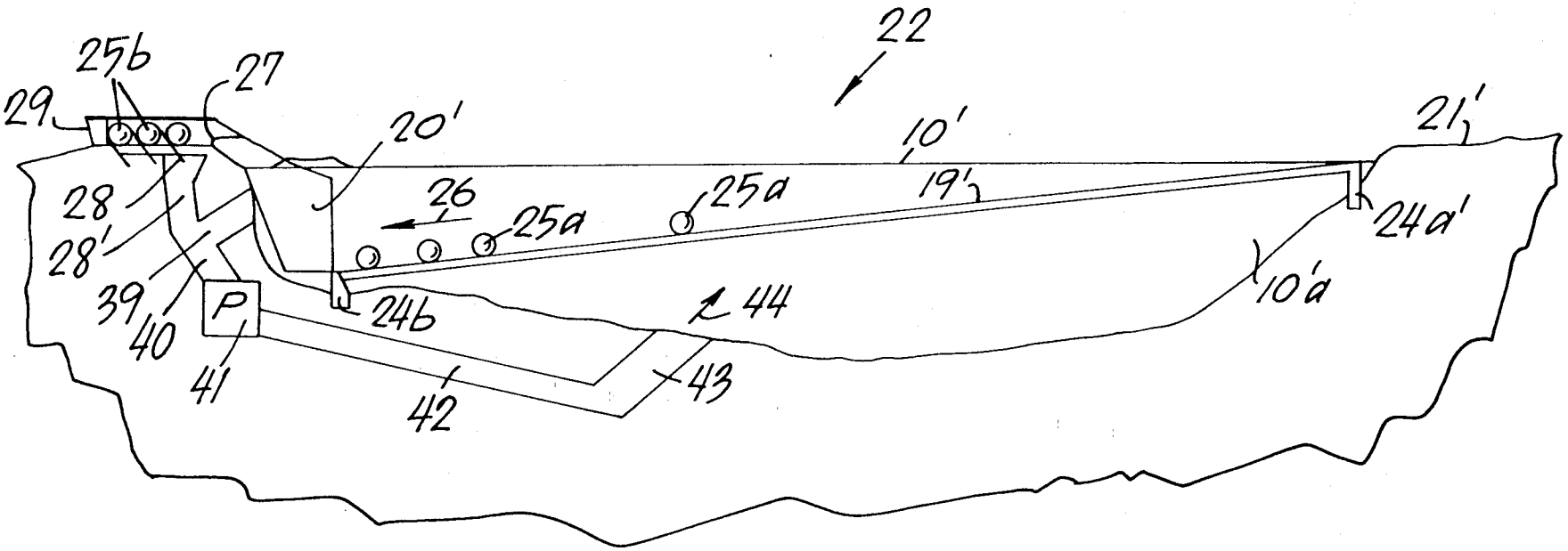

FIG. 2 diagrammatically illustrates an above-noted body of water 10' and positioned below water surface 10', is a golf ball collection device 19' downwardly inclined that directs golf balls 25*a* fallen into the body of water 10' to roll in direction 26 toward conventional centrifugal separator 20' from which the balls are ejected from outlet 27 into a collection trap-structure 29 having a ball retainer (such as a porous basket) adapted for retaining ejected golf balls 25*b*. Residual water passes downwardly through return pipe 39 having inlet 28, which joins with the main water-return pipe 39, thereupon passing through enlarged return pipe 40 into optional water-recycling conventional pump 41. From the pump 41, water is forceably (or by gravity) returned in direction 44 through outlet 43 into the body of water 10'. The body of water 10' is typically and symbolically surrounded by ground 21'. The golf ball collection device 19' is typically a porous or mesh corrosion resistant structure having anchoring supports such as typically 24*a* and 24*b* at typically opposite ends thereof, maintaining the collection device 19' in an effective taut state. As a typical alternate type pump and golf ball-collection mechanism, there may be a mere vacuum type arrangement resulting from an air pressurized line and pump driving that air, such that a suction tube sucks-up golf balls and immediately surrounding water which is thereafter directed from an exit end into a wire basket which retains the golf balls as the water passes therethrough and is channeled and/or pumped back through line or conduit 42 and its outlet 43 in direction 44. Typically the water containing the golf balls has a preferred minimum depth of about 1 to 2 feet, typically 1.5 feet, with the sloping member 19' sloping over a distance of typically and preferably 3 to 5 feet, but possibly being much longer as the situation provides and/or dictates.

FIG. 3 illustrates symbolically a typical one golf green 7 of the plurality of golf greens, having hole 12' and flag 13' associated therewith. At an edge of or appropriate distance from the golf green 7' there is/are one or more infra red detector(s) 30 emitting it/their infra red motion-detection beam/ray in direction(s) sufficient to substantially cover the green 7'. Upon detection of a "moving" golf ball, the infra red detector 30 sends a signal signifying such detection, through circuitry computer input feed lead lines 32, 32' into conventional computer 33 and associated conventional digitizer and sequence timer thereof jointly designated 33', from which the sequence modified and digitalized signal passes through monitor feed lines 34' where the digitalized signal is converted into a numerical or other conventional readable readout on the conventional monitor screen(s) 36 of the monitor(s) 35*a* and/or 35*b* or the like. Associated with the monitor(s) 35*a*, 35*b*, etc., is another conventional infra-red detector 30*a* positioned to detect movement of any golf ball struck from its particular booth, movement of the struck golf ball through the beam causing a signal to be transmitted through feed line 32' to the computer 33 at which it is synchronized and correlated by the conventional computer 33 with the subsequent striking of the ball on one of the greens 7' if such event takes place within a predetermined time period conventionally set in the computer. If no correlation (matching) takes place, as a result of the ball not falling on any one of the golf greens 7 (and/or other infra red covered area(s)) within the predetermined time measured from the time of the striking of the ball as detected by detector 30*a*, the computer will conventionally summarily transmit a no hit signal with a predetermined plus or minus value, to the monitor(s) 34, 34' and screens 36 thereof. Computer 33, the digitalizer 33', the monitors, and the infra red detectors are all powered by appropriate power source(s) 37 through power circuitry(ies) 37' and 37''. Likewise the ball-detection mechanism which may be conventional infra red detection and/or lever or button actuation-mechanism of conventional mechanical nature, detects any golf ball falling into the hole 12' and sends the signal to the monitor through the computer, digitalizer and sequence analyzer in the same manner and mode as as described infra red detector 30.

The size of the golf driving range of this invention is adaptable to any of various sizes and dimensions, dependent upon whether primarily intended and directed to children, adults, women, or the like, and may be adapted to any type of golf ball or its equivalent such that of a ball is utilized that travels only a nominally small distance when struck, the dimensions of the various elements of the described may be minimized to a much smaller area, within the scope of the present invention.

While where summer and/or warm weather abounds, associated with good grass cover over desired periods, the green may be natural grass. However, its is within the scope and intent of the invention to use carpets and/or other simulated or artificial grass or rugs or the like, and/or together with modified golf balls and/or modified golf clubs. The barriers preferably are sound absorbing, such as of conventional perforated cushioned material, to thereby minimize interfering noise, talk and/or laughter that might otherwise distract a person intent upon making a carefully thought-out finite stoke at swinging the golf club. The term golf club and golf tee and the like is intended to encompass equivalent structures and obvious modifications thereof under other names and with such clubs and/or balls as may be appropriately modified within the scope of the invention as described and herein claimed.

Target green 7*a* is located in substantially the center of the water hazard 10*a*, with the target green 7*a* being approximately and typically about 100 to about 125 yards from the tee area(s) 5 forward of the golf driving range.

Target green 7*b* is located slightly beyond and substantially to the left of the water hazard 10*a* and is approximately and typically about 150 to about 165 yards from the tee area(s) 5.

Target green 7*c* is located slightly beyond and to the right of the water hazard 10*a* and is approximately and typically about 150 yards to about 165 yards from the tee area(s) 5.

Target green 7*d* in combination with other target greens typically resembles a baseball field for example, with a substantially centralized hole(s) and flag(s) thereof. This target green 7*d* is beyond the water hazard 10*a* and is approximately and typically about 175 to about 190 yards from the tees and as above-noted preferably has an elevation of about 10 to 20 feet above that of the surrounding fairway and other target greens 7*a*, 7*b* and 7*c*.

Typically the tee area(s) 5, separately normally referred to as tee-off positions, typically as shown from the driving range area and are typically positioned as illustrated in along an arcuate line or arc separately number in conventional operation for identification purposes and range up to typically 75 to 100 separate booths or tee-off positions substantially as shown.

While the area 16 has been broadly referred to as a sand trap putting green, for practicing striking balls toward any one of the holes 16*f* from different positions in any of the sand traps 16*d* and 16*f* across either of the opposite green portions 16*a* and 6*b* on opposite sides of the line 16*c*, or toward the line 16*c* itself, normally such practice area is referred to as a chopping area. Typically there would be no hitting of or at the ball positioned on the green portions 16*a* and/or 16*b* since persons there would be in potential jeorpardy of being hit with balls chopped (struck) in the sand trap(s) by other golfers (choppers). The line 16*c* is also symbolic of an upright relatively highly-extending fine wire barrier substantially separating the green portion 16*a* from the green portion 16*b* as a safety measure preventing balls chopped in the opposite sand traps 16*d* and 16*e* from potentially hitting players (choppers) in the opposite end traps.

While not illustrated nor the essence of the invention, there would be a parking area typically fronting the practice tees, practice sand trap chopping areas and minature golf course, and likewise would be a pro-shop at which golfing goods might be purchased and/or a snack bar and/or restaurant and/or other socializing pavilions and/or sitting areas.

Accordingly, it is within the scope and spirit of this invention to make such modifications and/or variations and/or substitutions of equivalents as would be apparent and/or within the skill of an ordinary artisan in this technology.

Accordingly, the golf driving range as above disclosed is in sharp contrast to and with prior art driving ranges that are merely open flat fields with yardage markers and mounds of grass covered-earth merely having flags that are supposed in the imagination to represent targets.

I claim:

1. A golf driving range comprising a golf driving tee means for providing at-least two spaced-apart golf driving tee areas each adapted for driving a golf ball by a manually swung golf club, and a golf driving fairway including a first plurality of separate golf greens each differently visually-identifiable from other golf greens, said first plurality being positioned within golf club driving distances from said golf driving tee means, and said golf driving fairway including a second plurality of hazard structures spaced apart from one-another, said second plurality including at-least one of trees, shrubs, and visual simulations thereof, positioned on said golf driving fairway of which at-least one of said trees, shrubs and simulations thereof is positioned in close proximity to at-least one of said first plurality, and further including a body of water substantially surrounding at least one of said first plurality of separate golf greens, and in which is positioned a golf ball collection means for directing golf balls falling into said body of water into a collection trap structure adapted for recovering golf balls.

2. A golf driving range of claim 1, including miniature golf means providing an area inclusive of a series of a plurality of miniature putting tees and miniature putting lanes and golf holes adapted for playing minature golf.

3. A golf driving range of claim 1, including at-least one practice putting green located substantially rearward of said golf driving tee area in a close proximity to said golf driving tee means.

4. A golf driving range of claim 3, in which said practice putting green includes in contact therewith at-least one sand trap.

5. A golf driving range of claim 4, including miniature golf means providing an area inclusive of a series of a plurality of miniature putting tees and miniature putting lanes and golf holes adapted for playing miniature golf.

6. A golf driving range of claim 5, including detector and signaling means for registering a golf ball striking or falling on any of said first plurality and for indicating onto which of said first plurality a golf ball has fallen.

7. A golf driving range of claim 10, in which said golf ball collection means including a channeling-means for directing golf balls downward a downwardly inclined plane thereof and the golf ball collection means further including a collection vessel and a centrifugal action separator adapted to separate golf balls from water and to direct separated balls to the collection vessel, and the golf ball collection means being for recycling separated water into said body of water.

8. A golf driving range of claim 1, including detector and signaling means for registering and positioned to register a golf ball rolling on one of said first plurality and for indicating onto which of said first plurality a golf ball is rolling.

* * * * *